US006213305B1

(12) United States Patent
Baker et al.

(10) Patent No.: US 6,213,305 B1
(45) Date of Patent: Apr. 10, 2001

(54) BULK BAG

(75) Inventors: Gerald Lynn Baker, Ardrossan; Dennis Duff Hutton, Edmonton, both of (CA)

(73) Assignee: Inter/Sales Corporation, Alberta (CA)

( * ) Notice: Subject to any disclaimer, the term of this patent is extended or adjusted under 35 U.S.C. 154(b) by 0 days.

(21) Appl. No.: 09/365,472

(22) Filed: Aug. 2, 1999

(30) Foreign Application Priority Data

May 26, 1999 (CA) ..... 2272829

(51) Int. Cl.[7] ..... B65D 19/00
(52) U.S. Cl. ..... 206/599; 206/600
(58) Field of Search ..... 206/386, 595, 206/596, 598, 599, 600; 108/50.1, 57.17, 57.31; 383/121.1, 127

(56) References Cited

U.S. PATENT DOCUMENTS 1,148,948 * 8/1915 Benjamin ..... 383/121.1
2,808,093 * 10/1957 Gilman ..... 206/599
3,425,472 * 2/1969 Marino ..... 206/599
4,100,859 * 7/1978 Clark, Jr. ..... 206/600
4,300,608 11/1981 Cuthbertson .
4,790,249 * 12/1988 Webb ..... 108/51.3
4,792,171 12/1988 Lamy .
5,285,731 * 2/1994 McIntyre ..... 108/51.3
5,377,600 * 1/1995 Speese et al. ..... 108/51.3
5,607,237 3/1997 LaFleur .
5,685,644 11/1997 Taylor .
5,785,175 7/1998 Cholsaipant .

* cited by examiner

*Primary Examiner*—Luan K. Bui
(74) *Attorney, Agent, or Firm*—Rodman & Rodman

(57) ABSTRACT

A bulk bag includes a flexible body having a bottom. At least one pair of tubular fork tine receiving members are arranged in parallel spaced relation across the bottom of the body. Fork tines from a forklift are insertable into the receiving members to lift the body.

8 Claims, 4 Drawing Sheets

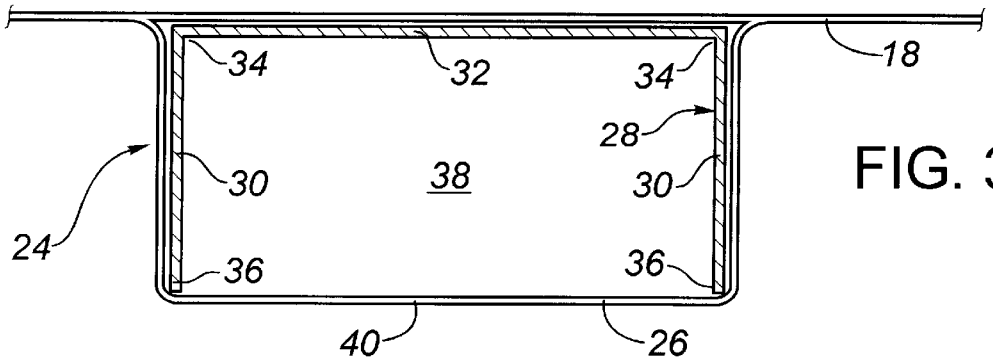
FIG. 3
FIG. 4
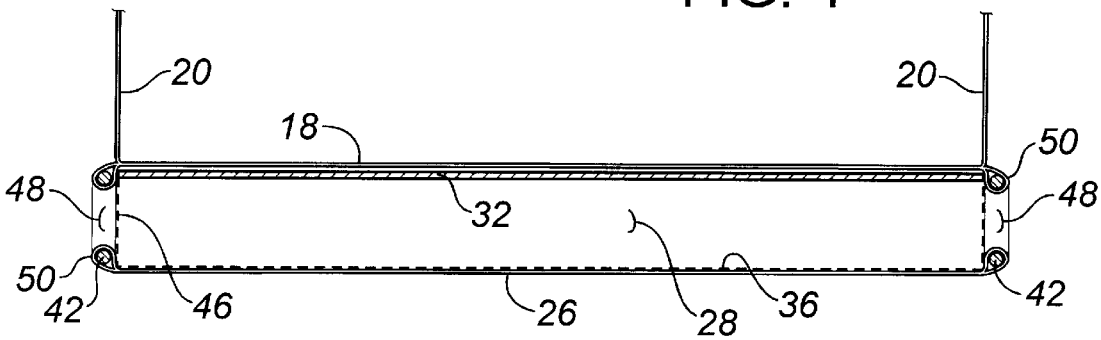

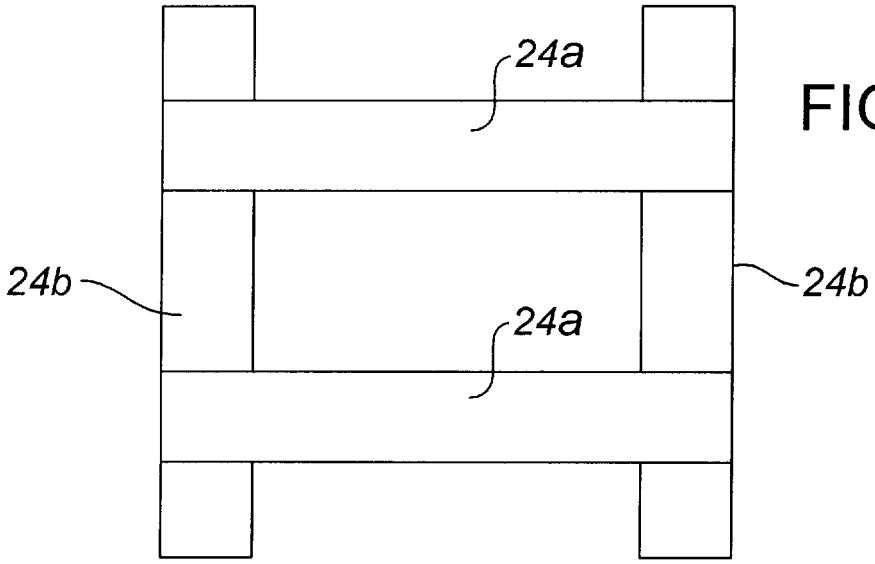
FIG. 8
FIG. 9
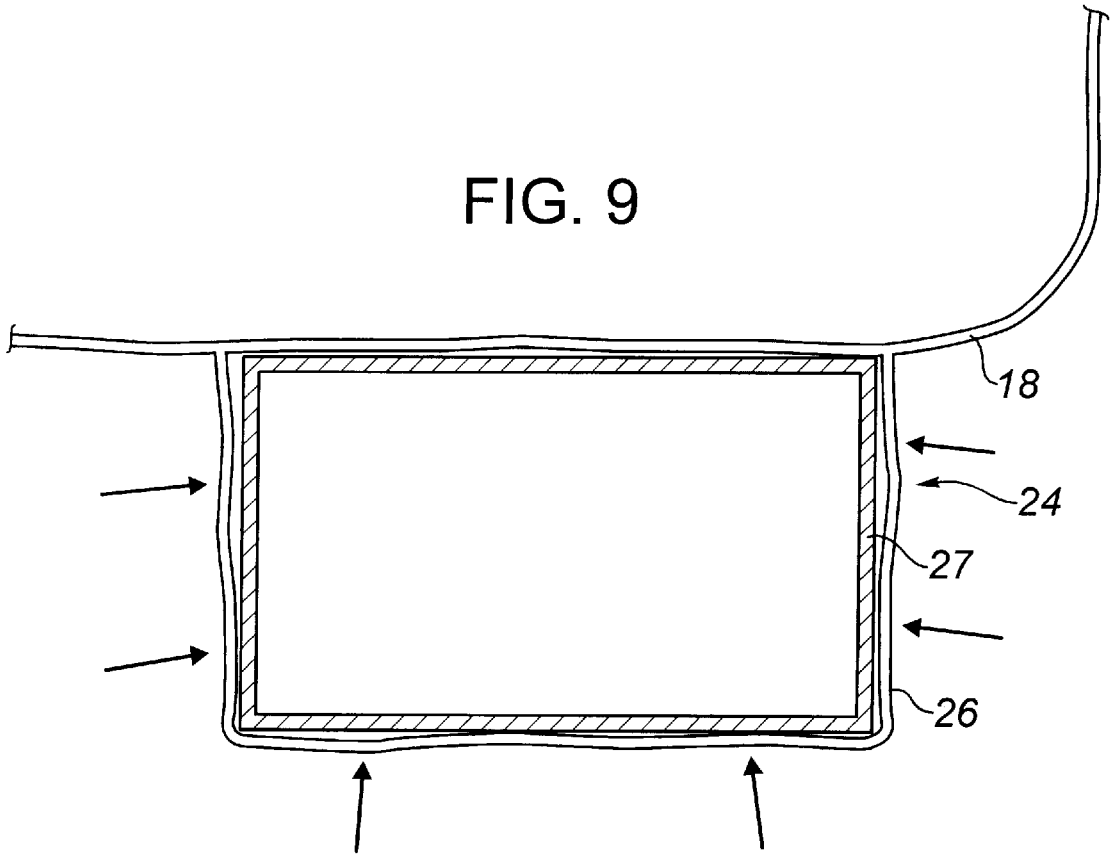

BULK BAG

FIELD OF THE INVENTION

The present invention relates to a bulk bag.

BACKGROUND OF THE INVENTION

Bulk bags are large bags that are used to transport bulk commodities. They are currently transported on low portable platforms known as "pallets." The use of pallets facilitates the handling of bulk bags with fork lifts. Unfortunately, pallets increase the weight and, consequently, the cost of shipping bulk bags. This involves both the transportation of full bulk bags from the shipper to the customer, and the transportation of empty bulk bags from the customer back to the shipper.

SUMMARY OF THE INVENTION

What is required is a bulk bag that can be readily transported without requiring a pallet.

According to the present invention there is provided a bulk bag which includes a flexible body having a bottom. At least one pair of tubular fork tine receiving members are arranged in parallel spaced relation across the bottom of the body. Fork tines from a forklift are insertable into the receiving members to lift the body.

The bulk bag, as described above, does not need a pallet as provision is made for receiving members to accommodate the fork tines of a forklift. This enables a forklift to be used to handle the bulk bags. The preferred mode of construction of the bulk bag involves making the fork tine receiving members in the form of sleeves that extend across the bottom of the bulk bag into which are inserted rigidifying inserts.

Although beneficial results may be obtained through the use of the bulk bag, as described above, rigidifying inserts can limit the extent to which empty bulk bags may be folded up for transport. Even more beneficial results may, therefore, be obtained when the rigidifying inserts are removable from the sleeves to facilitate transportation of empty bulk bags.

There are various ways in which rigidifying inserts may be maintained within the sleeves and yet, still remain removable to facilitate transportation of empty bulk bags. One way is to provide elastic bands at opposed ends of the sleeves to elastically deform the opposed ends. The elastic bands constrict the opposed ends of the sleeves to preclude the rigidifying inserts from being withdrawn from the sleeves. Another way is to provide a mating clamping component which clamps around the sleeve and onto the rigidifying insert. In this manner the rigidifying insert is clamped in position within the sleeve and cannot be withdrawn until the mating clamping component is removed. Yet another is to have sleeves made from an elastic material, that will stretch to allow entry of the rigidifying inserts and then return to their original form, thereby holding the rigidifying inserts in place.

Although beneficial results may be obtained through the use of the bulk bag, as described above, there is a danger that a fork lift may rupture the bulk bag when attempting to insert fork tines into the fork tine receiving members. Even more beneficial results may, therefore, be obtained when a peripheral reinforcing impact panel is secured to the sidewalls adjacent the bottom of the bulk bag in the vicinity of the at least one pair of tubular fork tine receiving members.

BRIEF DESCRIPTION OF THE DRAWINGS

These and other features of the invention will become more apparent from the following description in which reference is made to the appended drawings, wherein:

FIG. 3 is an end elevation view of the first embodiment of rigidifying insert illustrated in FIG. 2 inserted into a sleeve to form a fork tine receiving member.

FIG. 4 is a side elevation view, in section, of the rigidifying insert illustrated in FIG. 3.

FIG. 8 is a bottom plan view of four rigidifying inserts assembled to provide two pairs of fork tine receiving members.

FIG. 9 is an end elevation view of a third embodiment of rigidifying insert.

DETAILED DESCRIPTION OF THE PREFERRED EMBODIMENT

Figure 1:
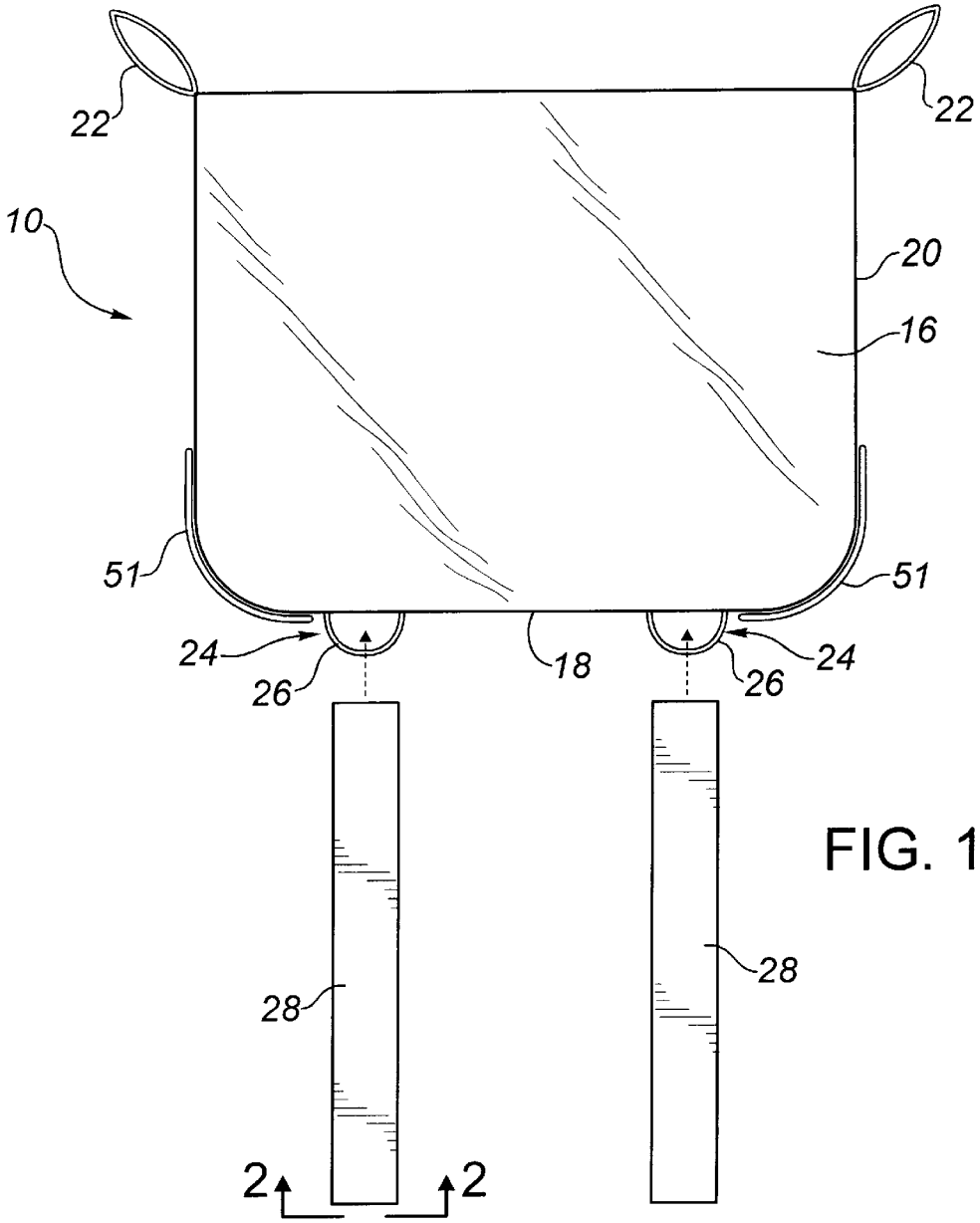
FIG. 1 is a side elevation view of a bulk bag having fork tine receiving members and rigidifying inserts constructed in accordance with the teachings of the present invention.

The two preferred embodiments of a bulk bag will now be described. A first embodiment generally identified by reference numeral 10 will be described with reference to FIGS. 1 through 4 and 8. A second embodiment generally identified by reference numeral 12 will be described with reference to FIGS. 1 and 5 through 8.

Referring to FIG. 1, first embodiment of bulk bag 10 includes a flexible body 16 having a bottom 18, a circumferential sidewall 20 and bag handling loops 22. A pair of tubular fork tine receiving members 24 are arranged in parallel spaced relation across bottom 18 of body 16, such that fork tines from a forklift are insertable into receiving members 24 to lift body 16. Fork tine receiving member 24 is a sleeve 26 with a removable rigidifying insert. As will hereinafter be further described, the rigidifying insert can take various forms. Referring to FIG. 9, the rigidifying insert can be a tubular member 27. It is preferred, however, that the rigidifying insert be in the channel form as will hereinafter be further described in relation to a first embodiment, which is identified in FIG. 2 by reference numeral 28. A channel form of rigidifying insert takes up less space during transportation.

Figure 2:
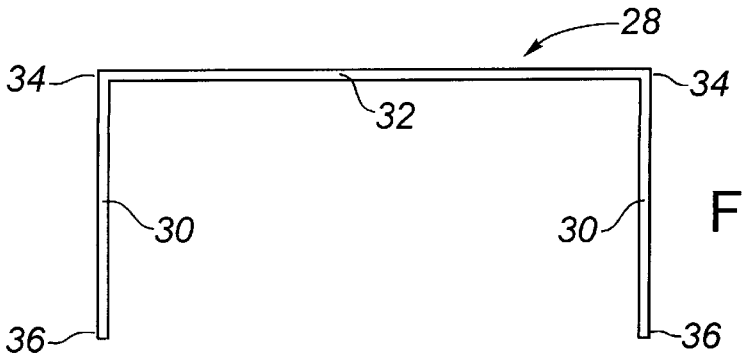
FIG. 2 is an end elevation view of a first embodiment of rigidifying insert.

Referring to FIG. 2, first insert 28 has a cross section shape that is substantially an inverted square channel. First insert 28 has a pair of sidewalls 30 in parallel spaced relationship and a top member 32. Top member 32 is rigidly affixed along the length of a top edge 34 of each sidewall 30 at an angle close to 90 degrees. A bottom edge 36 of sidewall 30 is linear and parallel to top edge 34, and is smooth thereby preventing tearing when first insert 28 is inserted into sleeve 26. First insert 28 is manufactured from a thermoplastic and is preferably of a gauge between 0.110 and 0.300. A height of sidewall 30 is between 2 inches and 5 inches, and a width of top member 32 is between 4 inches and 12 inches, the dimensions of first insert 28 being dependent on the dimensions of sleeve 26, body 16 and a maximum weight to be carried in body 16.

Referring to FIG. 3, first insert 28 is inserted into sleeve 26 so that top member 32 lies in a substantially coplanar attitude with and supports bottom 18 of body 16. A rectangular fork tine receiving member 24 having a cavity 38 is thereby formed by top member 32, pair of sidewalls 30 and a section 40 of sleeve 26 spanning a space between bottom edges 36 of sidewalls 30. Cavity 38 so formed is ready to receive a fork tine (not shown) from a forklift.

Referring to FIG. 4, elastic bands 42 are embedded in opposed ends 50 of sleeves 26. First insert 28 is installed by expanding elastic bands 42. When first insert 28 is installed within sleeve 26, elastic bands 42 are positioned between first insert 28, indicated by a dotted line 46, and an opening 48 at one of opposed ends 50 of sleeves 26. Elastic bands 42 elastically deform opposed ends 50, thereby precluding rigidifying first insert 28 from accidentally being withdrawn through opening 48. Referring to FIG. 9, the same effect can be obtained by having the entire of sleeve 26 made from an elastic material, such as an EVA flex plastic.

Referring to FIG. 1, it is preferred that a peripheral reinforcing impact panel 51 is secured to said sidewalls 30 in the vicinity of receiving members 24 in order to protect sidewalls 30 adjacent bottom 18 of body 16 against accidental puncture by fork tines of a forklift.

The method of use of first embodiment of bulk bag 10 will now be described with reference to FIGS. 1 through 4. First embodiment of bulk bag 10 is provided in a compactly folded form with first inserts 28 withdrawn from sleeves 26. Body 16 is unfolded and first inserts 28, as illustrated in FIG. 2, are inserted into sleeves 26, as illustrated in FIG. 3 by elastically expanding elastic bands 42. Once insertion has been completed, elastic bands 42 prevent first inserts 28 from accidentally being withdrawn from sleeves 26, as illustrated in FIG. 4. Once bulk bag 10 has been loaded, fork tines of a forklift are inserted into fork tine receiving channels 24, to lift and move first embodiment of bulk bag 10. Once the load has been discharged from bulk bag 10, inserts 28 are removed from sleeves 26. Body 16 can then be folded in preparation for body 16 and first inserts 28 being stored or transported in a compact form.

Figure 5:
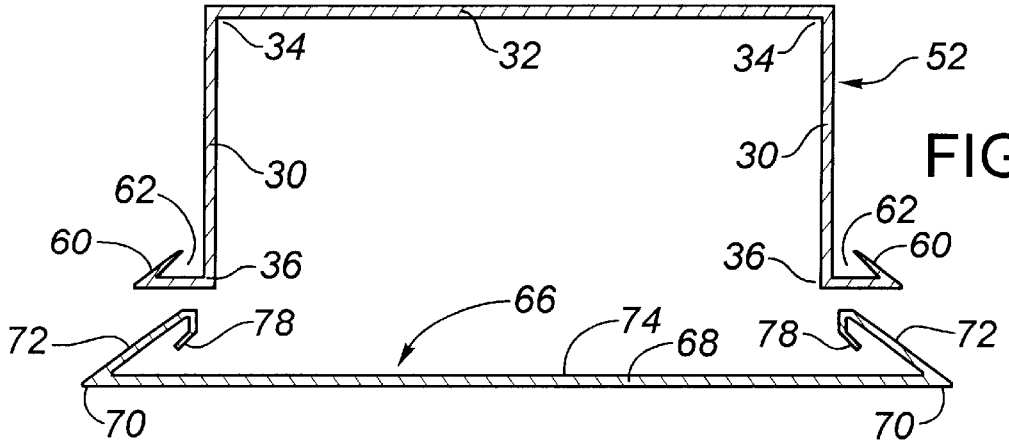
FIG. 5 is an exploded end elevation view of a second embodiment of rigidifying insert with mating clamping component.
Figure 6:
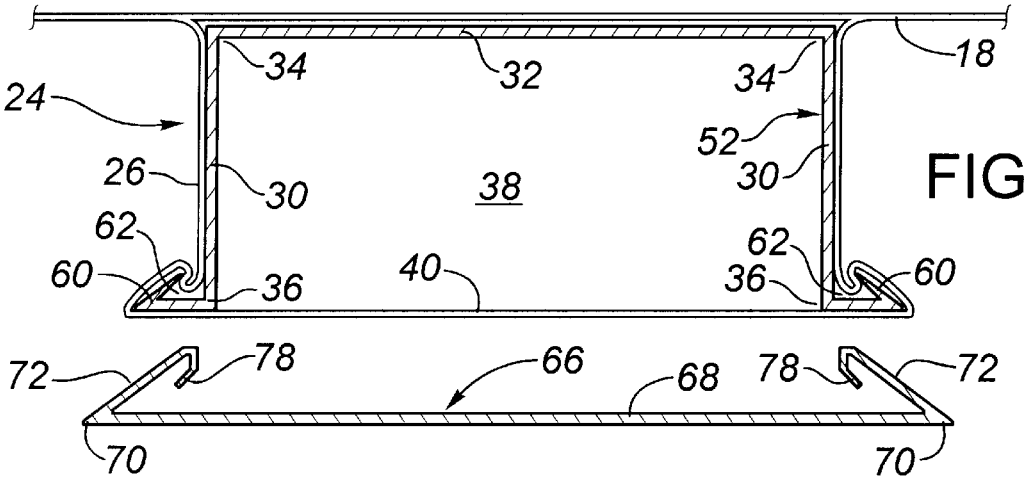
FIG. 6 is an exploded end elevation view of the second embodiment of rigidifying insert with mating clamping component illustrated in FIG. 5, and sleeve.
Figure 7:
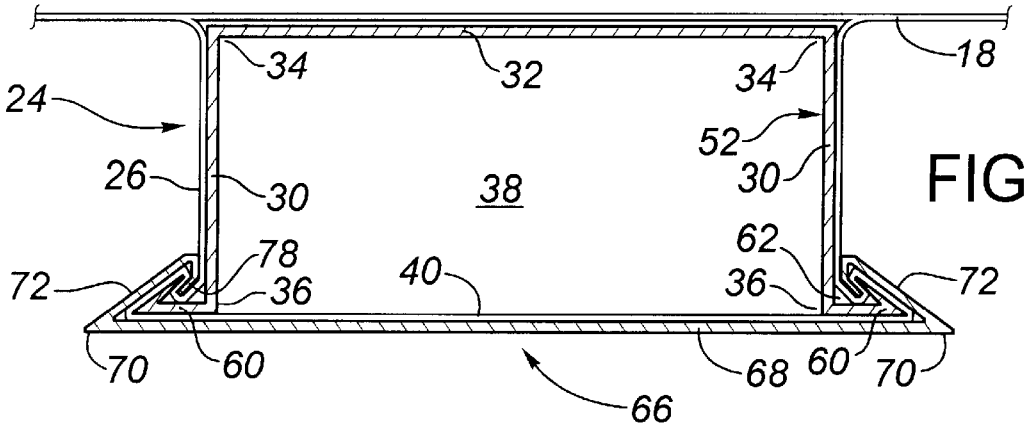
FIG. 7 is an end elevation view of the second embodiment of rigidifying insert with mating clamping component illustrated in FIG. 5, clamped onto a sleeve to form a fork tine receiving member.

Referring again to FIG. 1, second embodiment of bulk bag 12 includes flexible body 16 substantially similar to said body 16 described above for first embodiment of bulk bag 10. Fork tine receiving member 24 is a sleeve 26 with a second embodiment of insert generally identified by reference numeral 52. Referring to FIG. 5, second insert 52 is substantially similar to first insert 28, but with the additional feature that sidewall 30 has an angular "J" shaped foot 60 forming a channel 62 external to and along the length of a bottom edge 36 of sidewall 30. A mating component 66 is provided that has a planar base 68 with opposed parallel edges 70. An angular hook shaped member 72 extends along the length of each edge 70, spaced above top face 74 of base 68. Hook member 72 has an engagement lip 78. Referring to FIG. 6, second insert 52 fits loosely within sleeve 26. When second insert 52 is inserted into sleeve 26, top member 32 lies in a substantially coplanar attitude with and supports bottom 18 of body 16. A rectangular fork tine receiving member 24 having a cavity 38 is thereby formed by top member 32, pair of sidewalls 30 and a spanning section 40 of sleeve 26 spanning a space between bottom edges 36 of sidewalls 30. Cavity 38 so formed is ready to receive a fork tine (not shown) from a forklift. Referring to FIG. 7, mating component 66 mates with "J" shaped foot 60 on each opposed sidewall 30 of second insert 52. When so mated, engagement lip 78 of hook member 72 is positioned in channel 62 of "J" shaped foot 60. This clamps second insert 52 onto spanning section 40 of sleeve 26, thereby precluding second insert 52 from accidentally being withdrawn through opening 48 of sleeve 26.

The method of use of second embodiment of bulk bag 12 will now be described with reference to FIGS. 1 and 5 through 7. Second embodiment of bulk bag 12 is provided in a compactly folded form with second inserts 52 withdrawn from sleeves 26. Body 16 is unfolded and second inserts 52 are inserted into sleeves 26, as illustrated in FIG. 6. Engagement lip 78 of hook member 72 of mating component 66 is then mated with channel 62 to clamp second insert 52 onto spanning section 40 of sleeve 26. Body 16 is filled with a load and fork tines of a forklift are inserted into fork tine receiving channels 24 to lift and move bulk bag 10. When load has been discharged from body 16 mating component 66 is removed to enable second inserts 52 are removed from sleeves 26. Body 16 can then be folded in preparation for bulk bag and second inserts 52 being stored or transported in a compact form.

Referring to FIG. 8, two pairs of tubular fork tine receiving members 24 are used when there is a need to be able to lift bulk bag 10 from four sides, as opposed to two sides. A first pair of the tubular fork tine receiving members 24*a* crosses substantially perpendicularly a second pair of tubular fork tine receiving members 24*b*. A forklift can then approach a loaded bulk bag from any of four sides and insert fork tines into one of pair of fork tine receiving members 24*a* or pair of fork tine receiving members 24*b*.

In order to accommodate two pairs of receiving members 24, two pairs of intersecting or crossing sleeves 26 are preferably provided across the bottom 18 of the body 16, and two pairs of intersecting or crossing rigidifying inserts 28 are preferably provided for insertion in the sleeves 26. This can be accomplished by providing communication between the sleeves 26 at the point of their intersection and by providing notches in the rigidifying inserts 28 at their points of intersection so that they can be assembled in a single plane and still permit fork tines to access either pair of receiving members 24*a* or 24*b*. Alternatively, the two pairs of receiving members 24*a* and 24*b* could be located in different planes along the bottom 18 of the body 16, thus eliminating the need for intersecting or crossing sleeves 26 and rigidifying inserts 28.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A bulk bag, comprising:

a flexible body having a bottom and sidewalls; and at least one pair of tubular fork tine receiving members; wherein the receiving members are arranged in substantially parallel spaced relation across the bottom of the body such that fork tines from a forklift are insertable into the receiving members to lift the body and wherein each pair of tubular fork tine receiving members is comprised of a pair of rigidifying inserts, a pair of flexible sleeves depending from the bottom of the body for removably inserting the pair of rigidifying inserts therein and elastic bands positioned at opposed ends of the sleeves to elastically deform the opposed ends, thereby precluding the rigidifying inserts from being withdrawn from the sleeves.

2. The bulk bag as defined in claim 1, further comprising a peripheral reinforcing impact panel secured to the sidewalls adjacent the bottom in the vicinity of the at least one pair of tubular fork tine receiving members.

3. The bulk bag as defined in claim 1, wherein the bulk bag comprises two pairs of tubular fork tine receiving members, one of the two pairs of tubular fork tine receiving members crossing substantially perpendicularly another of the two pairs of tubular fork tine receiving members.

4. The bulk bag as defined in claim 1, wherein the rigidifying inserts are comprised of tubular members.

5. A bulk bag, comprising:

a flexible body having a bottom and sidewalls;

at least one pair of tubular fork tine receiving members arranged in parallel spaced relation across the bottom of the body, such that fork tines from a forklift are insertable into the receiving members to lift the body, the fork tine receiving members being comprised of sleeves with removable rigidifying inserts; and elastic bands positioned at opposed ends of the sleeves to elastically deform the opposed ends, thereby precluding the rigidifying inserts from being withdrawn from the sleeves.

6. The bulk bag as defined in claim 5, further comprising a peripheral reinforcing impact panel secured to the sidewalls adjacent the bottom in the vicinity of the at least one pair of tubular fork tine receiving members.

7. The bulk bag as defined in claim 5, wherein the bulk bag comprises two pairs of tubular fork tine receiving members, one of the two pairs of tubular fork tine receiving members crossing substantially perpendicularly another of the two pairs of tubular fork tine receiving members.

8. The bulk bag as defined in claim 5, wherein the rigidifying inserts are comprised of tubular members.

* * * * *